US005159939A

United States Patent [19]

Marritt et al.

[11] Patent Number: 5,159,939

[45] Date of Patent: Nov. 3, 1992

[54] METHOD OF AND APPARATUS FOR DELIVERING TOBACCO TO A CIGARETTE MAKER

[75] Inventors: Clifford R. Marritt, Winston-Salem; Francis R. Oakley, Kernersville; Gregory A. Holmes, Winston-Salem, all of N.C.

[73] Assignee: R. J. Reynolds Tobacco Company, Winston-Salem, N.C.

[21] Appl. No.: 600,387

[22] Filed: Oct. 19, 1990

[51] Int. Cl.[5] ..... A24C 5/14; A24C 5/18

[52] U.S. Cl. ..... 131/84.2; 1131/84.3; 1131/109.1

[58] Field of Search ..... 131/84.1–84.4, 131/108, 109.1, 282, 81.1

[56] References Cited

U.S. PATENT DOCUMENTS

| | | | |
|---|---|---|---|
| 2,311,373 | 2/1943 | Durning | 131/108 |
| 2,570,270 | 10/1951 | Patterson | 131/108 |
| 3,999,559 | 12/1976 | Marritt et al. . | |
| 4,135,615 | 1/1979 | Brackmann et al. . | |
| 4,214,695 | 7/1980 | Labbe et al. . | |
| 4,442,848 | 4/1984 | Seragnoli . | |
| 4,459,999 | 7/1984 | Brackmann et al. . | |
| 4,463,767 | 8/1984 | Seragnoli . | |
| 4,499,909 | 2/1985 | Seragnoli . | |
| 4,557,277 | 12/1985 | Seragnoli . | |
| 4,557,278 | 12/1985 | Brackmann et al. . | |
| 4,570,644 | 2/1986 | Ahern et al. . | |
| 4,595,026 | 7/1986 | Mattei . | |
| 4,600,021 | 7/1986 | Mattei . | |
| 4,681,124 | 7/1987 | Hinzmann et al. . | |
| 4,696,311 | 9/1987 | Chard et al. . | |
| 4,742,834 | 5/1988 | Labbe . | |
| 4,754,765 | 7/1988 | Brackmann et al. . | |
| 4,802,497 | 2/1989 | Hrboticky | 131/84.3 X |
| 4,867,180 | 9/1989 | Brackmann et al. . | |
| 4,875,495 | 10/1989 | Wheless . | |
| 4,953,570 | 9/1990 | Brackmann et al. . | |
| 4,967,770 | 11/1990 | Brackmann et al. . | |

OTHER PUBLICATIONS

Molins Limited Machine Manual for Cigarette Making Machine Mark 9N, published as Issue 1, May 1978, pp. 13.12–13.13.

Airblock Literature, published by Rothmans of Pall Mall Limited, undated.

*Primary Examiner*—Vincent Millin

*Assistant Examiner*—J. Doyle

[57] ABSTRACT

An apparatus and method of delivering smokable material to a cigarette maker with reduced degradation of the smokable material. A vertical reservoir tube is provided directly overhead of a plurality of rotatable and longitudinally vibratable rollers having interdigitating pins attached thereto. The rollers serve to meter and open the smokable material. The opened smokable material then falls as a shower from the rotating rollers to a convergent channel formed by two walls oriented at different angles to the horizontal. Air flow channels are provided which feed air along each wall, thereby providing an essentially laminar stream of air downwardly along the walls. An arrangement of multiple hoppers is also provided which permit blending of different types of smokable material prior to forming the smokable material into a braid and feeding the braid to the cigarette maker garniture.

32 Claims, 8 Drawing Sheets

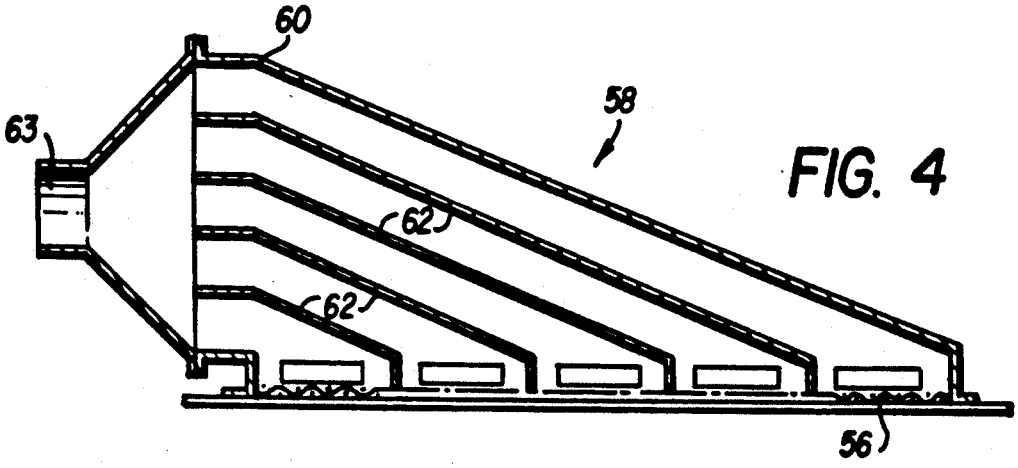
FIG. 4
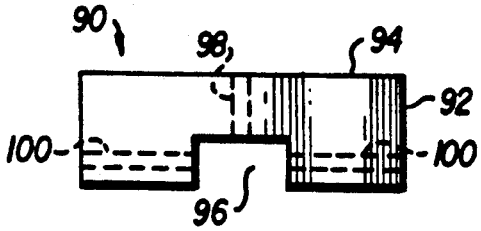
FIG. 7
FIG. 5
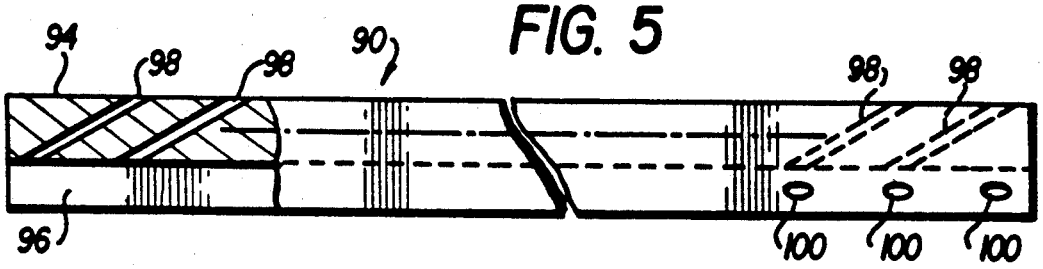
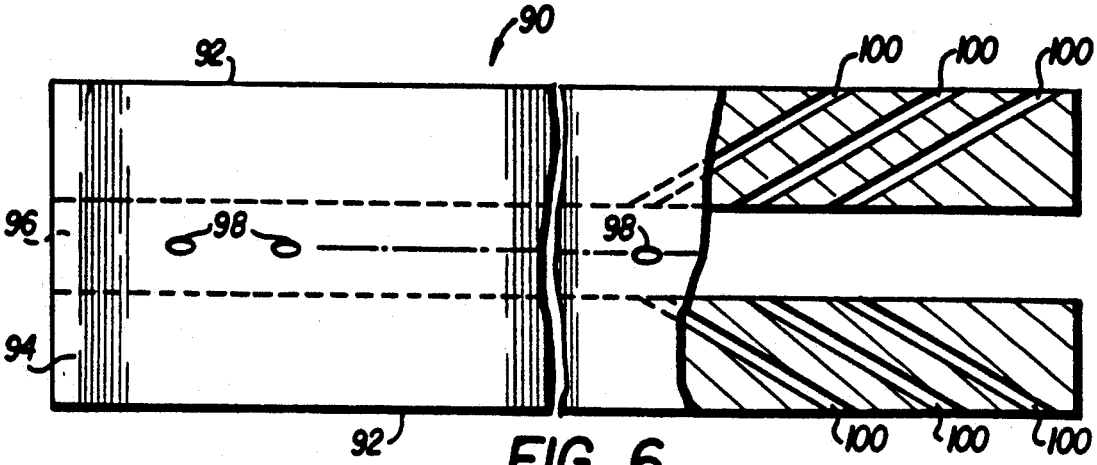
FIG. 6

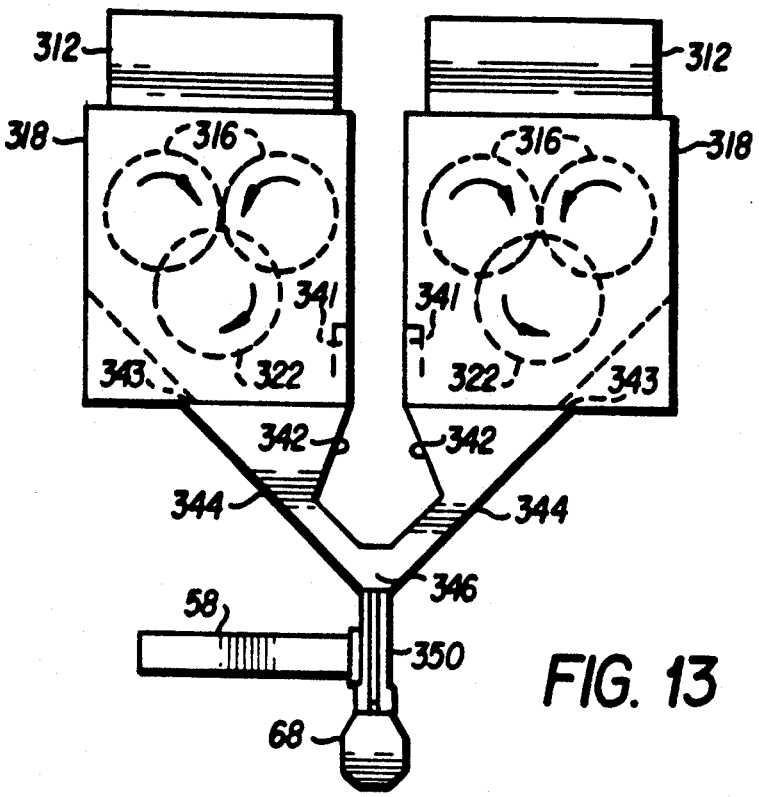
FIG. 13
FIG. 11
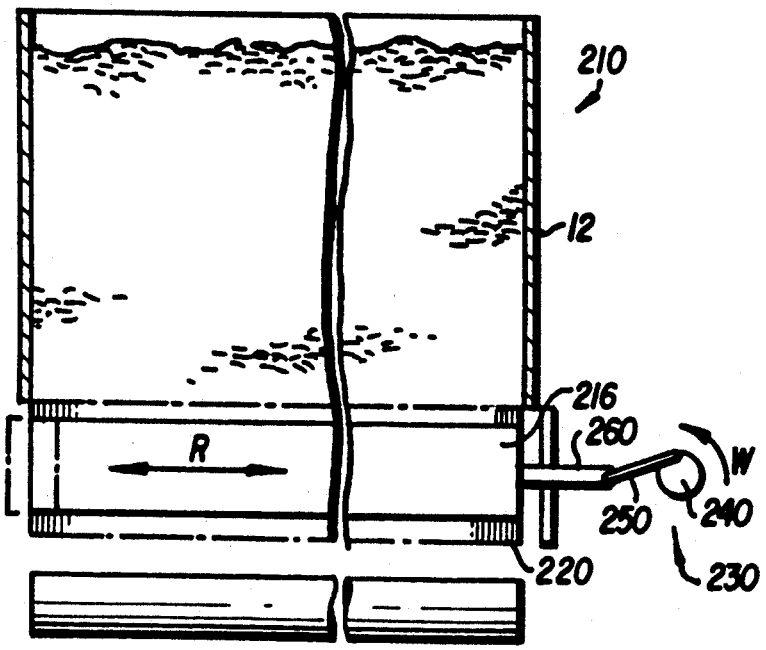

METHOD OF AND APPARATUS FOR DELIVERING TOBACCO TO A CIGARETTE MAKER

FIELD OF THE INVENTION

The present invention relates to a hopper apparatus and a method for metering and opening smokable material, such as tobacco cut filler, and delivering the smokable material to a suction belt for conveyance to a cigarette making machine. The invention is more specifically related to an apparatus and method which minimizes the degradation of the tobacco cut filler or other smokable material by gently handling the smokable material.

DESCRIPTION OF THE PRIOR ART

Popular smoking articles, such as cigarettes, have a substantially cylindrical rod-shaped structure and include a roll or charge of smokable material, such as shredded tobacco material (e.g., in cut filler form), wrapped in a paper wrapper, thereby forming a so-called "smokable rod". Normally, a cigarette has a cylindrical filler element aligned in an end-to-end relationship with the smokable rod. Typically, a filter element includes cellulose acetate tow circumscribed by plug wrap, and is attached to the smokable rod using a circumscribing tipping material.

Smokable filler material or cut filler normally has the form of strands or shreds, and normally is provided from "strip" materials. Cut filler normally is provided at cut widths of about 1/5 inch to about 1/60 inch; preferably about 1/25 inch to about 1/35 inch; and generally at lengths of about 0.25 inch to about 3 inches. The types of smokable filler materials can vary, and usually include flue-cured, Burley, Maryland and Oriental tobaccos, as well as the rare and specialty tobaccos, tobacco substitutes and tobacco extenders, and blends thereof. Tobacco cut filler usually is provided in the form of tobacco laminae, volume expanded or puff tobacco laminae, processed tobacco items such as cut-rolled or cut-puff stems, and processed tobacco materials such as cast reconstituted tobacco paper and extruded reconstituted tobacco.

The manufacture of cigarettes requires smokable material, such as tobacco cut filler, to be conveyed pneumatically from a holding device or apparatus to a cigarette making machine. Such smokable material is fibrous in nature, being comprised to a significant extent of strands of material. Typically, a hopper is employed, in which smokable material is handled by a series of cooperating rollers having interdigitating pins thereon which meter the smokable material and open it up, as well as by elevating belts which move the smokable material between sections of the hopper apparatus. Such movement typically involves the step of metering of the smokable material and the step of separating and spreading out of the smokable material strands in a process known in the art as "opening" or "singulating." In moving the smokable material from the storage device to the cigarette maker, the smokable material is subjected to considerable contact with moving and non-moving parts of the apparatus, resulting in degradation of the smokable material. The typical prior art hoppers employ carding rollers for opening or singulating the smokable material and refusers to trim off excess smokable material from the carded rollers. Vertical entrainment of the smokable material by air currents is often employed to move the material to the underside of a suction belt and then conveying the material to the garniture of a cigarette making machine.

Examples of prior art patents directed to hoppers and cigarette makers which handle tobacco cut filler in the above-described manner include the following: U.S. Pat. Nos. 4,499,909 to Seragnoli; 4,557,277 to Seragnoli; 4,570,644 to Ahern et al.; 4,463,767 to Seragnoli; 4,442,848 to Seragnoli; 4,600,021 to Mattei; 4,875,495 to Wheless; and 4,214,595 to Labbe et al.

In order to alleviate the excessive handling of smokable material in the aforementioned prior art devices, an apparatus intended to eliminate many of the handling steps and elements and replaces them with an essentially vertical arrangement in which the smokable material is fed from a metering column to a plurality of rollers which meter and spread the tobacco. For example, in U.S. Pat. No. 4,867,180 to Brackmann et al. there is disclosed a vertical hopper which feeds the nip of two counterrotating interdigitating metering rollers which interdigitate with an opening roller which feeds a carding drum or a conveyor belt to form a tobacco filler rod. Light tobacco particles are separated from heavy tobacco particles by an upwardly directed air stream which carries the light tobacco particles to the underside of a suction belt where the particles form a tobacco filler rod. U.S. Pat. No. 4,953,570 to Brackmann et al. discloses counterrotating interdigitating rollers from which an opened stream of tobacco is directed against an adjustable sloping wall and then onto a conveyor. Other patents disclosing counterrotating interdigitating rollers are U.S. Pat. Nos. 4,459,999 and 4,557,278, both to Brackmann et al.

In addition to the aforedescribed hopper arrangements, the prior art also teaches the use of vibrating members for distributing tobacco. U.S. Pat. No. 4,681,124 to Hinzmann et al. is directed to a tobacco manipulating apparatus having a duct which is comprised of two opposed parallel walls, a portion of at least one of which is vibrated transverse to the direction of tobacco through the duct. The walls have protuberances and grooves formed therein. The duct leads to a carded roller.

The prior art also teaches multiple tobacco streams and blending of tobacco streams. Among these prior art references are U.S. Pat. Nos. 4,696,311 to Chard et al.; 4,595,026 to Mattei; and 4,135,615 to Brackmann et al.

Other patents which teach apparatus for moving smokable material to and around suction belt surfaces include U.S. Pat. Nos. 4,742,834 to Labbe and 3,999,559 to Marritt et al.

It is desirable to reduce or eliminate the degradation of smokable material by reduced handling and/or contact with hard surfaces and moving parts.

SUMMARY OF THE INVENTION

The present invention overcomes the shortcomings of the prior art by providing an apparatus and method for introducing smokable material such as tobacco cut filler to a cigarette maker in a manner which reduces and/or eliminates degradation of the smokable material. Preferably, the smokable material supplied to the apparatus of the invention has previously been cut, cased (humectant and flavoring added), and typically winnowed. The present invention eliminates the necessity for the prior art refuser, carding drum refuser system, picking from the carding drum and picking from the pinned metering drum. The invention also minimizes contact of the smokable material with hard surfaces as it is metered and singulated or opened. This is accomplished according to the present invention by providing a vertical reservoir tube directly overhead of a plurality of rotatable rollers having interdigitating pins attached thereto. The rotatable rollers serve to meter and open or singulate the smokable material. The singulated smokable material then falls as a shower from the rotating rollers to a convergent channel formed by two walls oriented at different angles relative to horizontal. Air flow channels are provided which feed air along each wall, thereby providing an essentially laminar stream of air downwardly along, and essentially parallel to, the walls. Smokable material is entrained in the air flow so as to prevent that material from striking the channel walls. Upward entrainment, as in the prior art, is eliminated, so that there is no abrupt directional and velocity change in motion of the smokable material, thereby reducing degradation of the smokable material.

Disposed at the bottom of the convergent channel is an essentially vertical throat having a porous region on one vertical side. A conventional supercharger is attached to the porous side of the throat and provides suction to create the air flow along the convergent channel walls. The throat provides a shape sufficient to form the singulated smokable material into a braid which is deposited on the upper run of a continuous moving suction belt which is part of a first suction chamber of a dual suction chamber arrangement. A dual suction chamber arrangement is provided in which each suction chamber is divided by a partition into two subchambers. A first pressure gradient is established between the first subchamber of the first (lower) suction chamber and the first subchamber of the second (upper) suction chamber, which holds the smokable material braid on the suction belt of the first suction chamber. A second pressure gradient in the opposite direction to the first pressure gradient is established between the second subchamber of the first suction chamber and the second subchamber of the second suction chamber. This second pressure gradient serves to transfer the braid of smokable material from the suction belt of the first suction chamber to the suction belt of the second suction chamber and to hold it thereon. This second suction belt then transports the braid to the garniture of a cigarette making machine. As used herein, a braid is defined as a stream of smokable material in cut filler form having a cross section conforming to the shape of the channel in which it resides and having a density less than the density of a smokable material rod formed from the braid in a cigarette making machine. Normally, the braid has an essentially rectangular or square transverse cross section.

In one embodiment of the invention, the metering of smokable material is performed by two counterrotating rollers having pins thereon which feed a stream of smokable material to a rotating singulating roller, also having pins thereon, and located immediately below the two counterrotating rollers. The counterrotating rollers rotate in a direction such that the smokable material is drawn from the reservoir tube downwardly into the nip of the rollers. The singulating roller is operated at a higher rotation rate than the two metering rollers. Because of the differential rate of feed of smokable material to the singulating roller relative to the rate of discharge of smokable material from the metering rollers, the smokable material is opened or spread apart. Smokable material is discharged from the singulating roller as a shower toward the more vertically oriented wall of the two walls of the convergent channel.

In a second embodiment of the invention, only two counterrotating rollers having pins thereon are provided. In addition to being counterrotated, the rollers are counter-vibrated or asynchronously reciprocated along their respective longitudinal axes. Such rotation and reciprocation produces a shower of metered, singulated smokable material. As a result of employing only two rollers, the smokable material falls from the nip or interdigitating zone of the two rollers as a somewhat dispersed shower. Thus, rather than having the two walls of the convergent channel oriented at different angles relative to horizontal, those walls are oriented at the same angle relative to horizontal, in the case of straight walls, and oriented in mirror-image fashion in the case of curved walls generally conforming to the contours of the two rollers. The nip or interdigitating region of the rollers is typically centered over the essentially vertical throat.

Either of the metering/singulating roller embodiments can be used in a third embodiment which comprises an arrangement of multiple hoppers which permit blending of different types of smokable material prior to forming the smokable material into a braid and feeding the braid to the cigarette maker garniture.

The method of the present invention includes the steps of providing a supply of smokable material, metering and opening the smokable material, with the opened smokable material having a component of velocity in the direction of gravity, entraining the opened smokable material in an airstream having a vertically downward component of velocity thereby increasing the velocity of the smokable material, guiding the entrained smokable material downwardly, converging the entrained smokable material and forming the entrained smokable material into a braid on the suction belt for transport ultimately to the garniture of a cigarette making machine. The transport or transfer of the braid to the garniture of a cigarette making machine includes the steps of: conveying the braid on a first movable surface located at a position beginning beneath the throat of the hopper; applying a first pressure gradient across the first movable surface so as to retain the braid on the first movable surface; terminating or otherwise reducing the first pressure gradient across the first movable surface; at or near the location of termination of the first pressure gradient, applying a second pressure gradient across a second movable surface so as to transfer the braid from the first movable surface to the second movable surface and to retain the braid thereon; conveying the braid on the second movable surface to the garniture of the cigarette making machine.

In one embodiment of the method, the metering and opening steps are performed by three separate cooperating devices. In a second embodiment of the method, the metering and opening steps are performed by two separate cooperating devices. In a third embodiment of the method, multiple devices are provided for performing the steps of providing a supply of smokable material, metering and opening the smokable material, and entraining the opened smokable material in an airstream. The third embodiment of the method also can include a further step of in-line blending of smokable material so that different brands of cigarettes can be made on the same maker without first having to empty and reload the hopper.

The method of any of the embodiments herein further includes the step of feeding a single throat device from multiple streams of entrained smokable material, thereby forming the entrained smokable material into a braid for transport to the garniture of a cigarette making machine.

BRIEF DESCRIPTION OF THE DRAWINGS

FIG. 4 is a sectional view of a supercharger conduit taken along section 4—4 of FIG. 2;

FIG. 5 is a sectional side view of a rail cap air block;

FIG. 6 is a top view of the rail cap air block of FIG. 5;

FIG. 7 is an end view of the rail cap air block of FIG. 5;

FIG. 11 is a side elevational view of the smokable material metering and singulating stage of the second embodiment shown in FIG. 10;

FIG. 13 is an end elevational view of a third embodiment employing two smokable material metering/singulating stages and air entrainment stages combined to form an apparatus for blending tobacco.

DETAILED DESCRIPTION OF THE INVENTION

Figure 1:
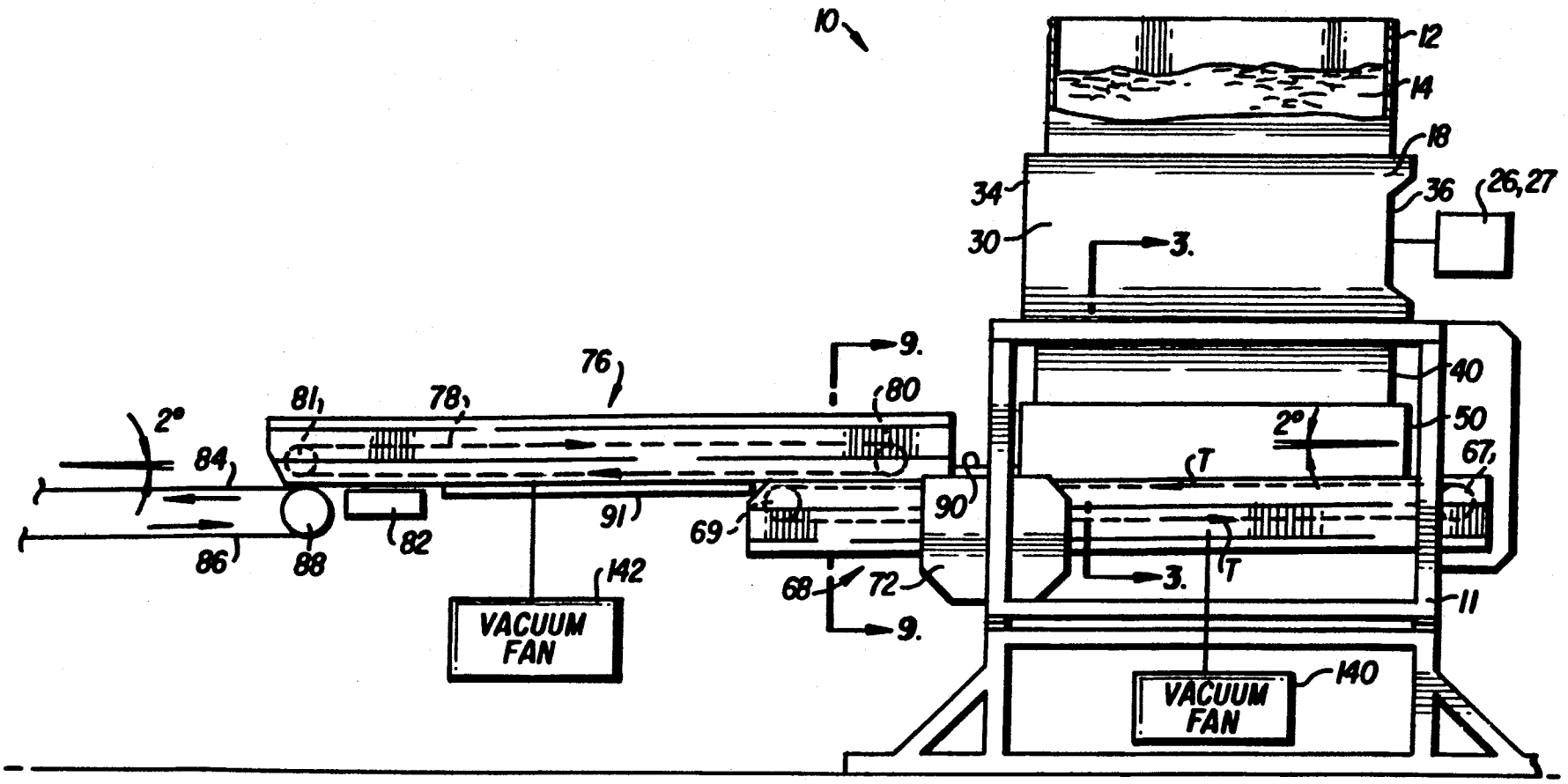
FIG. 1 is a side elevational view of a hopper apparatus according to the present invention.
Figure 2:
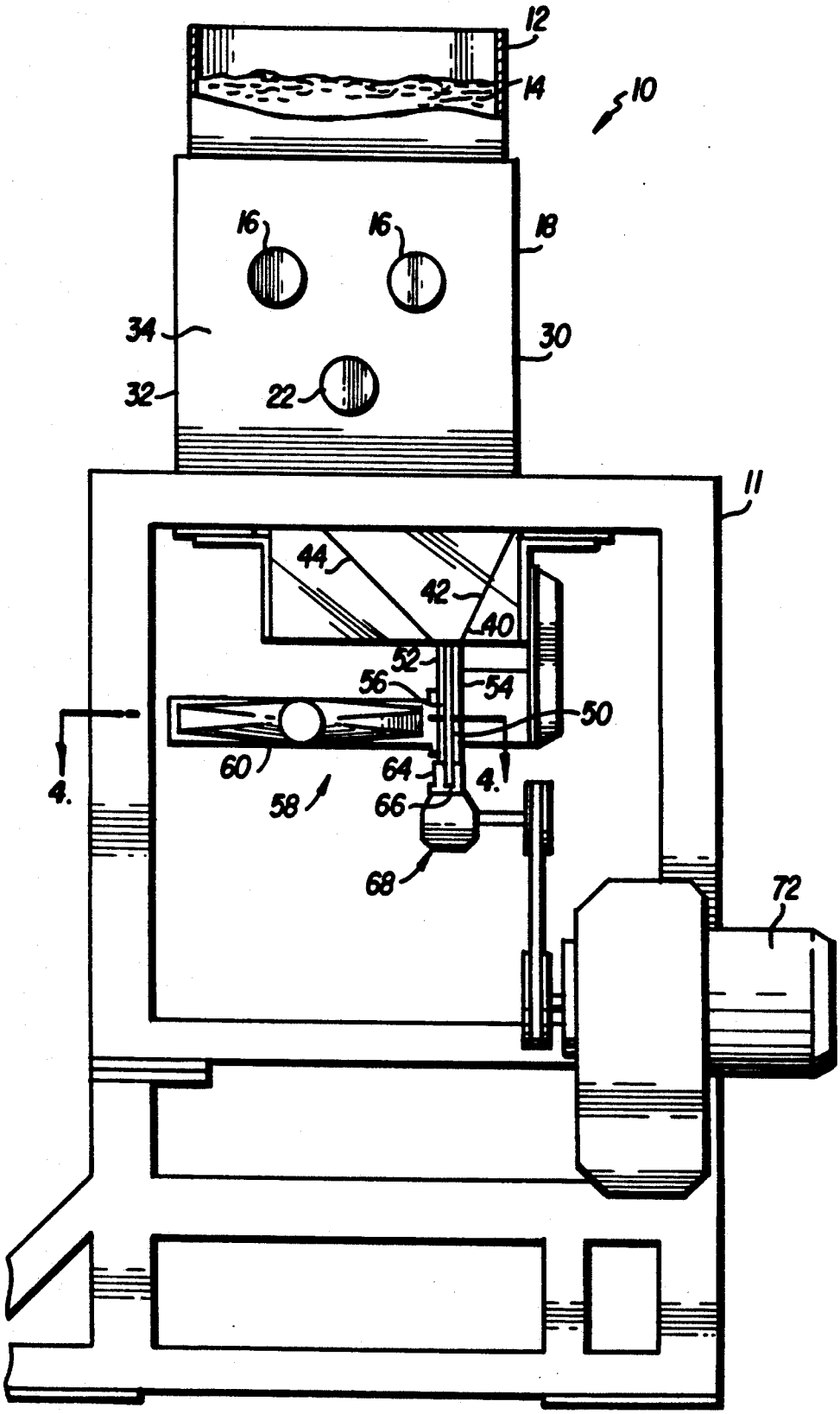
FIG. 2 is an end elevational view of a hopper apparatus according to the present invention.

Referring now in detail to the drawings wherein like parts are designated by like reference numerals throughout, there is illustrated in FIG. 1 a side elevational view of a hopper apparatus 10 embodying the invention for feeding tobacco or smokable material, which has previously been cut, cased and winnowed, to a cigarette maker. FIG. 2 shows an end elevational view of the hopper 10, and FIG. 3 shows a sectional view of the hopper 10.

Figure 3:
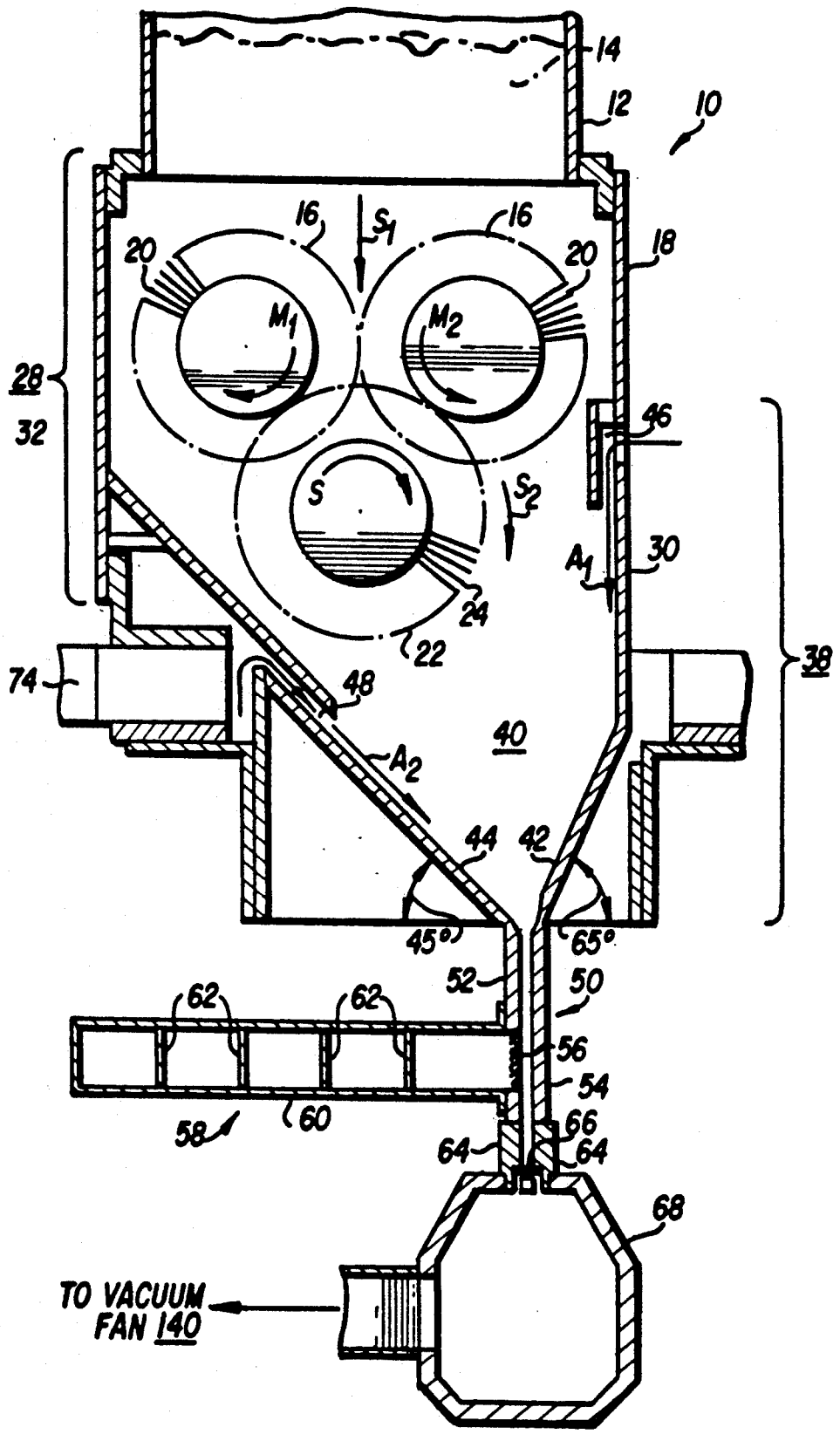
FIG. 3 is a sectional view taken along section 3—3 of FIG. 1 of a detail of a first embodiment of the smokable material metering and singulating stage and air entrainment stage of the present invention.

The major components of hopper 10 are shown in FIGS. 1-3. The hopper 10 comprises a frame 11 on which is mounted an upright reservoir tube 12 open at both its upper and lower ends for holding smokable material and having a rectangular cross-section. At its upper end, the reservoir tube 12 communicates with a source of cut, cased and winnowed smokable material, which forms a mass 14 of smokable material in the tube. The lower end of the reservoir tube 12 communicates with a pair of metering rollers 16 which are mounted in a flow-through housing 18 of rectangular cross-section on parallel axes and have radially-directed pins 20 to meter a flow of smokable material from the mass 14 contained in the reservoir tube 12. A third singulating roller 22 is also mounted in roller housing 18 and is positioned to rotate on a longitudinal axis substantially equidistantly positioned and hence parallel to the axes of the metering rollers 16. The singulating roller 22 has radially directed pins 24 which interdigitate with the metering roller pins 20 so as to open the metered flow of smokable material and separate the individual particles one from another, as explained below. Rollers 16, 22 are driven by motors 26 and 27 mounted on roller housing 18. The reservoir tube 12 and rollers 16, 22 mounted in housing 18 constitute a metering and singulating stage of the present invention, designated generally by the numeral 28. This hopper is of the type described generally in U.S. Pat. No. 4,754,765 to Brackmann et al.

Roller housing 18 is comprised of side walls 30 and 32 and end walls 34 and 36 to which rollers 16, 22 are mounted. The roller housing 18 is adapted to provide an entrainment stage, designated generally by the numeral 38, mounted substantially below the metering and singulating stage 28. The entrainment stage 38 includes an entrainment chamber 40 formed by convergent walls 42 and 44 and air inlets 46 and 48. Air inlet 46 is mounted on and forms part of wall 30 of roller housing 18. Air inlet 48 is mounted in and forms part of wall 44.

Entrainment chamber 40 is mounted above and feeds smokable material to a throat 50, which includes throat walls 52, 54 and screen 56 which is the porous part of wall 52. Mounted on the side of throat wall 52 is a supercharger box assembly 58. The supercharger box assembly 58 is comprised of a convergent duct 60 having dividers 62 therein which divide the flow of air evenly along the length of throat 50. Exemplary superchargers are of the type described in Molins Limited Machine Manual for Cigarette Making Machine Mark 9N, published as Issue 1, May 1978. See in particular pages 13.12-13.13.

Mounted directly below throat 50 is rail 64 which fits over the upper run of a suction belt 66 which forms a portion of a suction chamber 68. The suction belt 66 is a continuous porous belt trained about an arrangement of pulleys and rollers shown generally as pulleys 67, 69 and driven by a motor 72.

A second suction chamber 76, having continuous porous suction belt 78 trained about an arrangement of pulleys and rollers shown generally as pulleys 80, 81 is aligned with suction belt 66 to receive a braid of smokable material therefrom. The braid of smokable material is carried on the lower run of suction belt 78 in the direction shown and is trimmed by trimmer 82. This second suction chamber 76 in turn is aligned to transfer the braid of smokable material onto a paper wrapper (not shown), the paper wrapper residing on a garniture belt 86 trained about pulley 88 and then through a garniture tongue (not shown) of a cigarette rod (not shown) in a conventional manner. Vacuum fans 140, 142 are connected respectively to suction chambers 68, 76 in a conventional manner which will be apparent to the skilled artisan. A detailed description of the suction chamber arrangement is provided below for FIGS. 8 and 9.

Metering rollers 16 and singulating roller 22 are typically approximately 30 inches in length. The diameter of rollers 16, including the radially extending pins 20, is approximately 7.5 inches. The pins 20 are approximately 0.1 inches in diameter and of two lengths, either 1.0 inch long or 1.5 inch long, and are set radially around the roller 16 so that there are approximately 36 pins per inch of roller length in the axial direction of the roller 16. Roller 22 is approximately 8.5 inches in diameter, with pins 24 having a diameter of approximately 0.25 inch and a length of approximately 2.0 inches, also set at 36 pins per inch. Suitable reservoir tube 12 and rollers 16, 22 are those which equip a flow-through hopper commercially supplied by Control and Metering, Ltd., Toronto, Ontario, Canada.

Wall 42 of entrainment chamber 40 is preferably oriented 65° from the horizontal, whereas wall 44 is preferably oriented approximately 45° from the horizontal. Throat 50 is typically approximately 0.315 inch wide.

Suction chamber 68 may be of the type used in a VE-80 hopper assembly of a Protos cigarette maker, manufactured by Hauni-Werke Korber and Co., KG. Suction chamber 68 is mounted inverted at the base of throat 50. Suction chamber 76, the intermediate suction chamber for transferring a braid of smokable material eventually to the garniture of a cigarette maker, also may be of the type used in a VE-80 hopper, but is mounted upright rather than inverted. The pressure in the suction chambers 68, 76 typically ranges from 65–95 millibars.

Both suction chamber 68 and suction chamber 76 are preferably parallel in orientation and are oriented at a downward inclination of approximately 2 degrees toward garniture 84. Suction belt 78 overlaps with suction belt 66 by approximately 18 inches so as to permit the transfer of the smokable material braid from suction belt 66 upwardly to suction belt 78 at a point on suction belt 78 spaced from pulley 80.

FIG. 4 shows a section taken through 4—4 of FIG. 2 of supercharger box assembly 58. Supercharger box assembly 58 is a convergent duct 60 having dividers 62 therein which divide the flow of air evenly along the length of throat 50. The exit end 63 of supercharger box assembly 58 is attached to a screen 56 to form a supercharger such as a Molins-type supercharger, such as that shown in Molins publication Issue 1, May 1978 which draws air through the wall screen 56 of throat 50.

FIGS. 5, 6 and 7 show the details of rail cap air blocks 90 and 91. The construction of the rail cap air blocks 90,91 is the same. Therefore, only the rail cap air block 90 is described in detail, as follows. Rail cap air block 90 is a cover member comprising walls 92 and top 94 and having a U-shaped cross-section which forms a longitudinal cavity 96. Openings in the form of holes 98, 100 are drilled or otherwise provided at an angle into top 94 and walls 92, respectively and intersect with cavity 96. The angle of each of the holes 98, 100 as measured relative to the longitudinal axis of cavity 96 is preferably approximately 30 degrees oriented from the outer surface of the rail cap air block 90 to the inner surface in the same general direction of movement as the suction belt 66. The holes 98 and 100 permit ambient air to pass through to suction belt 66 and thence to suction chamber 68 to reduce an abrupt pressure gradient. As shown in FIG. 3, the belt 66 of suction chamber 68 resides within and is guided by rails 64, and throat 50 mates with rails 64 to form a seal therebetween. Rail cap air block 90 is mounted over rails 64 downstream of throat 50, as viewed in the direction of motion of suction belt 66 (and hence smokable material rod motion) as shown by the arrow T in FIG. 1. Rail cap air block 90 preserves the suction pressure on suction belt 66 and provides a decreasing pressure gradient up to the point at which suction belt 66 cooperates with suction belt 78 to transfer the smokable material rod upwardly onto suction belt 78. Rail cap air block 90 for Molins Mark 8 or 9 cigarette making machines is available from Control and Metering, Ltd. and is described in literature published by that organization.

Figure 8:
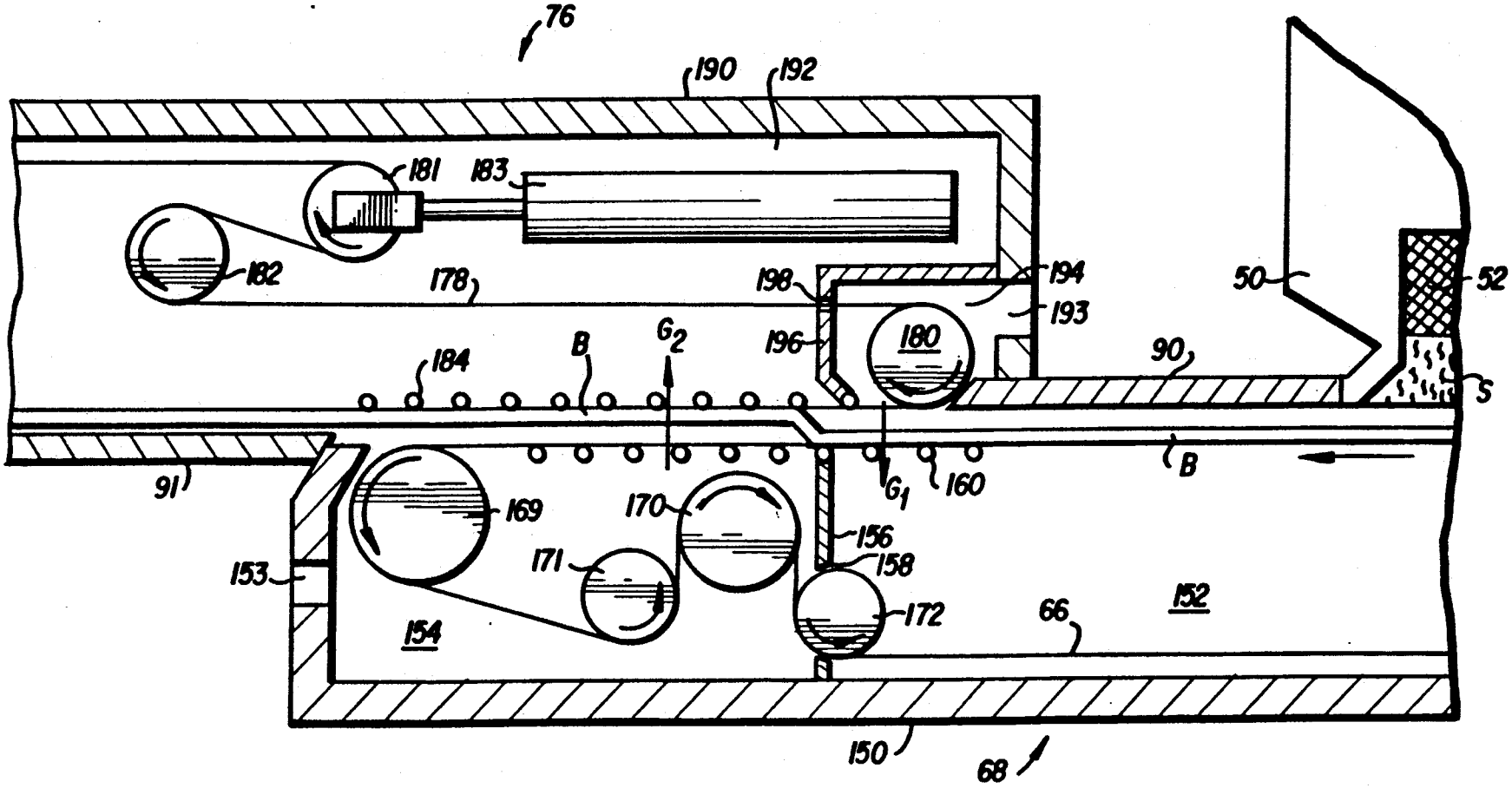
FIG. 8 is a partial sectional view of the interface between suction chambers taken along section 8—8 of FIG. 9.
Figure 9:
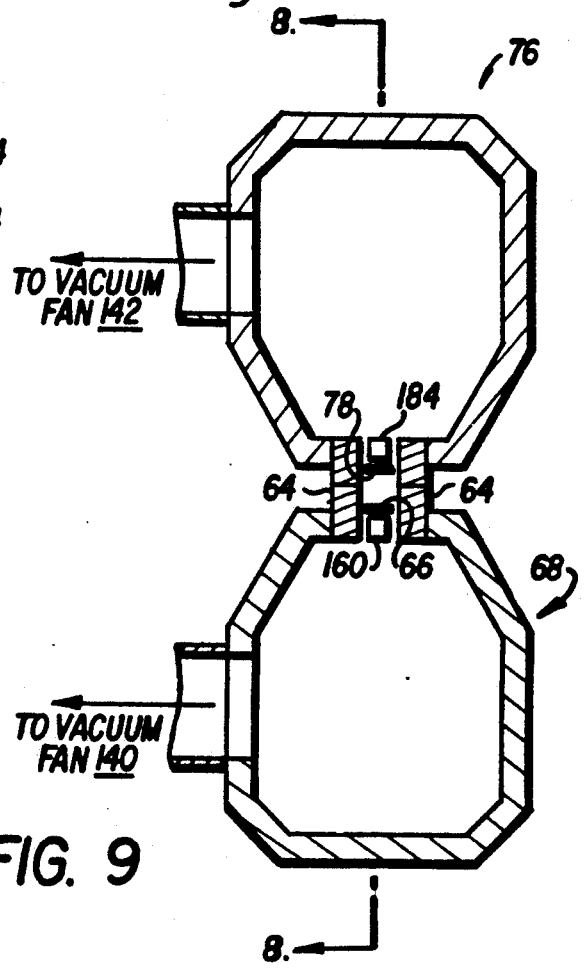
FIG. 9 is an end sectional view of the interface between suction chambers taken along section 9—9 of FIG. 1.

FIG. 8 shows a partial cross-sectional view of the interface of lower suction chamber 68 with upper suction chamber 76. FIG. 9 shows an end sectional view of the interface between the suction chambers 68 and 76. Lower suction chamber 68 is comprised of a housing 150 which is divided into two subchambers 152 and 154 by a partition 156. Arranged within housing 150 are pulley 169, suction belt drive roller 170, belt tensioner roller 171 and fixed guide roller 172. A suction belt 66 is trained about the pulleys and rollers and passes through passage 158 in partition 156, as shown in FIG. 8. Suction belt 66 is also trained about an end pulley, not shown, as for example, end pulley 67 of FIG. 1. Rollers 160 are disposed beneath the upper run of suction belt 66 to support the belt.

Upper suction chamber 76 is comprised of a housing 190 which is also divided into two subchambers 192 and 194 by a partition 196. Suction belt 78 is trained about pulley 180, belt tensioner 181, fixed guide rollers 182 and rollers 184, and passes through slot 198 in partition 196. Tension is maintained on belt 78 by tensioning air cylinder 183. Belt 78 is driven by a belt drive roller, not shown, and is trained about an end pulley, also not shown, such as end pulley 81 of FIG. 1.

Subchamber 152 of lower suction chamber 68 and subchamber 192 of upper suction chamber 76 are each connected to respective vacuum fans 140 and 142, as indicated in FIG. 9. Subchamber 194 of suction chamber 76 and subchamber 154 of suction chamber 68 are each open to atmosphere, as for example through openings 193 and 153. Rail cap air block 90 is mounted on rails 64 between the hopper apparatus throat 50 and upper suction chamber 76. Similarly, rail cap air block 91 is mounted on rails 64 to provide a transitional pressure region along belt 78.

The operation of this dual suction chamber arrangement will now be described. Smokable material S from throat 50 is deposited to form a braid B on lower suction belt 66 of suction chamber 68, which is moved in the direction toward upper suction chamber 76. The pressure gradient from atmospheric in subchamber 194 to subatmospheric in subchamber 152 results in a net suction in the direction from subchamber 192 to subchamber 152, as shown by arrow G1. Similarly, the pressure gradient from atmospheric in subchamber 154 to subatmospheric in subchamber 192 results in a net suction in the direction from subchamber 154 to subchamber 192, as shown by arrow G2. This results in transfer of the braid B from the top of lower suction chamber belt 66 to the underside of upper suction chamber belt 78.

In the above-described configuration, the smokable material is transferred between the upper and lower flights of the suction belts 66 and 78, respectively, and thus does not have to travel around the pulleys of a suction belt. However, it is contemplated that a single suction belt and pulley arrangement can be used in lieu of suction chambers 68, 76 to feed the garniture 84 of the cigarette maker. In such case a porous pulley such as that disclosed in U.S. Pat. No. 3,999,559 to Marritt et al. can be employed. With that arrangement, the direction of motion of the suction belt under throat 50 would be away from the cigarette maker, that is, opposite to the direction of motion of belt 66 as shown by arrow T in FIG. 1. The braid of smokable material would be carried around the pulley of the suction chamber corresponding to pulley 67 and then onto the underside of the chamber where it would then be trimmed and deposited onto the cigarette maker garniture 84 in a manner similar to that described for suction chamber 76.

FIG. 3 illustrates in greater detail the structure of the hopper 10. Smokable material is provided to reservoir tube 12 and the mass 14 of smokable material resides atop the two metering rollers 16 in roller housing 18. The metering rollers 16 each have a plurality of pins 20 which interdigitate. Metering rollers 16 counterrotate towards each other as shown by arrows $M_1$ and $M_2$, at preferably 2–3 rpm. A stream of smokable material shown as arrow $S_1$, is fed to a singulating roller 22, having a plurality of pins 24. Singulating roller 22 rotates at a higher rate than rollers 16, preferably at approximately 200 rpm. This higher rate of rotation results in opening up or singulating the smokable material. The singulated smokable material is carried around the periphery of roller 22, as shown by arrow $S_2$, until it reaches a point where the material falls as a shower under the force of gravity toward entrainment chamber wall 42.

Air enters entrainment chamber 40 through air inlets 46 and 48 which run substantially horizontally the length of walls 30 and 44, respectively and are open to ambient atmosphere, but alternatively could be connected to a recirculating duct. Two streams of air, designated $A_1$ and $A_2$, are drawn by the supercharger (not shown) connected to the supercharger box assembly 58 through the entrainment chamber 40, one stream $A_1$ through air inlet 46 and the other stream $A_2$ through air inlet 48. These two airstreams are drawn down through throat 50 and out supercharger box assembly 58. Thus, an additional velocity component in the direction of gravity is imparted to the smokable material. Airstreams $A_1$ and $A_2$ preferably have laminar flow characteristics.

Metered smokable material transferred by metering rollers 16 onto singulating roller 22 is directed to fall toward wall 42, the entrainment chamber wall oriented more toward the vertical so as to reduce the extent that the smokable material impacts on the hard surface of the walls of entrainment chamber 40. This arrangement results in the shower of smokable material descending from the singulating roller 22 being entrained primarily in airstream $A_1$, and to a lesser extent in airstream $A_2$, thereby providing a more vertically downward flow and minimizing the contact between the smokable material and walls 42 and 44. This reduced contact with hard surfaces such as walls 42, 44 results in decreased degradation of smokable material over the prior art. The air-entrained smokable material is directed generally toward throat 50, through which it flows onto suction belt 66 (FIG. 3). The combination of air entrainment along converging walls results in the smokable material being guided toward throat 50 and also gently converged toward throat 50. The generally downward velocity of the smokable material is typically in the range of about 25–35 feet per second just before reaching the suction belt 66.

Figure 10:
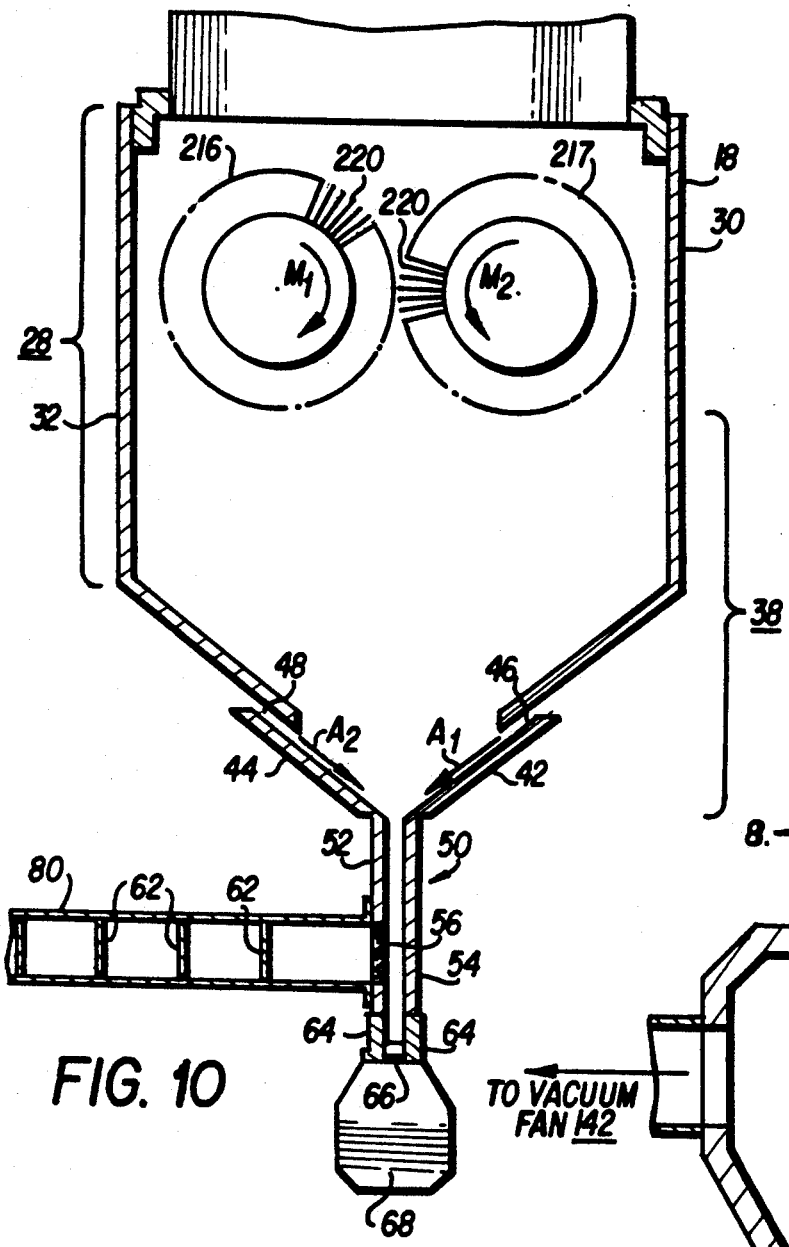
FIG. 10 is an end elevational view of a second embodiment of the smokable material metering and singulating stage and air entrainment stage of the invention having straight walls.

An alternative embodiment 210 of the metering roller and singulating arrangement is shown in FIGS. 10 and 11. Except as described below, the components of this embodiment are designated with the same reference numerals as the first embodiment. In this alternative embodiment, the singulating roller is eliminated. Instead, two metering rollers 216, 217 having interdigitating pins 220 serve both to meter and to open the smokable material. This is accomplished by counterrotating the two rollers 216, 217 at a relatively slow rate, while at the same time reciprocating the rollers out of phase (preferably 180° out of phase) along their longitudinal axes at a relatively high frequency, but small amplitude. Typically, the rollers 216, 217 are approximately 8 inches in overall diameter, including pin length, with the pins being approximately 0.1 inch in diameter and approximately 1.0 inch long. The pins are set radially around the rollers preferably at approximately 72 pins per inch of roller axial length.

As in the first embodiment, air inlets 46, 48 are provided to admit airstreams A1, A2 along converging walls 42, 44. Such airstreams serve to entrain the smokable material, as in the first embodiment. Since the smokable material is showered from the interdigitating region of the metering rollers 216, 217, throat 50 is preferably located essentially directly below this interdigitating or nip region. Nonetheless, some of the smokable material will be sprayed outwardly from the metering rollers 216, 217 and hence will fall toward walls 42, 44. Thus, entrainment is still desirable to minimize contact of the smokable material with the walls 42, 44. Converging walls 42,44 are oriented at the same angle relative to horizontal, preferably approximately 45 degrees.

Reciprocation is accomplished as shown in FIG. 11, using an eccentric designated generally with reference numeral 230. An eccentrically mounted crank arm 250, mounted by a pin to a wheel 240, drives a longitudinal shaft 260 attached to each roller 216. Wheel 240 rotates as shown by arrow W; rollers 216 reciprocate as shown by arrow R. The pin attachments of each roller 216 to the eccentric 230 are offset on opposite sides of the eccentric 230, thus generating the out of phase reciprocation. Reciprocation of the rollers also can be achieved through other means such as cam action or air percussion. Reciprocation by any means will ensure the effect of this arrangement, which is both to meter and singulate the smokable material, which forms a shower that is entrained as explained above. The preferred rate of rotation of rollers 216 is approximately 2 to 3 rotations per minute. The preferred frequency of reciprocation of rollers 216 is approximately in the range of 1000 to 3000 cycles per minute, with an amplitude in the range of approximately 0.03 to 0.1 inches. Alternatively, it is contemplated to vibrate and rotate only one of the rollers while the other rotates only.

Figure 12:
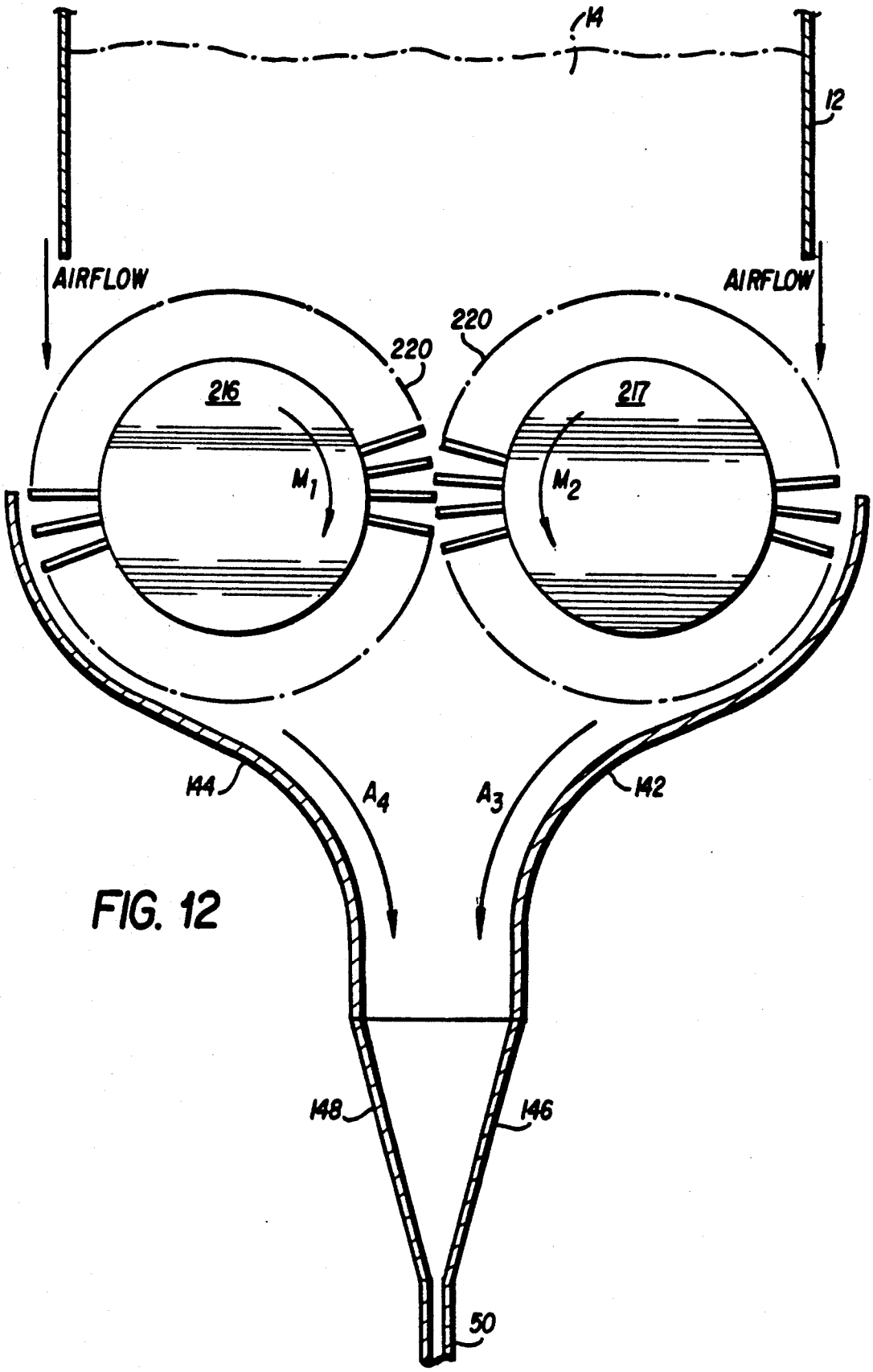
FIG. 12 is an end elevational view of a second embodiment of the smokable material metering and singulating stage and air entrainment stage of the invention having curved walls.

An alternative wall arrangement for the second embodiment of the vibrated metering and singulating roller system is shown in FIG. 12. In this alternative embodiment, walls 142, 144 are curved to follow generally the contours of rollers 217, 216, respectively, and form a convergent channel leading to two steeply sloped straight walls 146, 148 attached to throat 50. Air streams $A_3$, $A_4$ are formed by air flows provided to the outer sides of rollers 217, 216, respectively, as shown. Walls 146, 148 are each angled at an angle of preferably approximately 75 degrees from the horizontal. Otherwise, the operation of the embodiment is the same as described for the straight-walled embodiment using the vibrating metering and singulating rollers.

FIG. 13 shows a combination of multiple hoppers comprising a plurality of rollers and entrainment chambers which serve to blend smokable material traversing the throat 350. As described above, the smokable material in each hopper has been cut, cased and winnowed. In this arrangement, two or more hoppers each having a reservoir tube 312, a roller housing 318, roller sets 316, 322 and an entrainment chamber 340 having convergent walls 342, 344 with respective air inlets 341, 343, are configured to feed to a blending zone 346 which leads to a single throat 350. A supercharger box assembly 58 and a suction chamber 68 are also provided. The speed of rotation and metering of the individual roller sets determines the amount of each type of smokable material which is blended together at blending zone 346. Any of the roller embodiments described above can be employed for this blending arrangement, with appropriate adjustment of the wall angles and location of the rollers relative to the throat.

This arrangement of feeding a single throat from multiple hoppers permits the blending of smokable material for immediate feed into a cigarette-making machine. Thus, without reconfiguring the cigarette maker or hopper, different blends of smokable materials for different cigarette brands can be effected by altering the smokable material placed in the metering columns and adjusting the quantity of smokable material actually metered by altering the rotation rates of the metering rollers 316. Furthermore, this embodiment incorporating multiple hoppers offers a number of advantages over prior blending arrangements. The metered quantities of smokable material from the two or more hoppers are blended prior to contacting the suction belt 66 of suction chamber 68 (FIG. 3). By introducing two components of smokable material in a singulated form and by mixing converging airstreams, very uniform blending is possible. The likelihood of subsequent deblending is reduced since blending takes place immediately prior to cigarette braid formation.

It is contemplated that other advantages exist if two or more hoppers feed a common throat 350. For example, in this embodiment, the basic blend components of regular tobacco cut filler can be fed directly to the cigarette maker, thereby eliminating blending of the tobacco cut filler components at the primary blender. This eliminates the possibility of subsequent deblending and degradation of the tobacco cut filler.

A system is contemplated incorporating an embodiment having two or more feed hoppers and having a keyboard or other controls to enter information to obtain a specific blend by setting the metering rates of the feed hoppers. This embodiment, in combination with a direct flavor application after braid formation but before reaching the garniture using a flavor dispensing unit available as a Model FDU2 SYSM from C. B. Kaymich & Co., Ltd., Sheffield, England, provides further manufacturing flexibility and versatility.

The method of the present invention includes the steps of providing a supply of smokable material which has previously been cut, cased and winnowed, metering and opening the smokable material, with the opened smokable material having a component of velocity in the direction of gravity, entraining the opened smokable material in an airstream, collecting the opened smokable material and forming the collected entrained smokable material into a braid for transport to the garniture of a cigarette making machine. The transport or transfer of the braid to the garniture of a cigarette making machine includes the steps of: conveying the braid on a first movable surface located at a position beginning beneath the throat of the hopper; applying a first pressure gradient across the first movable surface so as to retain the braid on the first movable surface; terminating or otherwise reducing the first pressure gradient across the first movable surface; at or near the location of termination of the first pressure gradient, applying a second pressure gradient across a second movable surface so as to transfer the braid from the first movable surface to the second movable surface and to retain the braid thereon; and conveying the braid on the second movable surface to the garniture of the cigarette making machine.

In one embodiment of the invention, the metering and opening steps are performed by three separate cooperating devices. In a second embodiment of the invention, the metering and opening steps are performed by two separate cooperating devices. In a third embodiment of the invention, multiple devices are provided for performing the steps of providing a supply of smokable material, metering and opening the smokable material, and entraining the opened smokable material in an airstream. The method employing these multiple devices performing the aforementioned steps further includes a step of feeding a single throat device for forming the entrained smokable material into a braid for transport to the garniture of a cigarette making machine. This latter embodiment of the method permits at-the-maker blending of smokable material so that different brands of cigarettes can be made on the same maker without unloading and reloading the hopper.

Tobacco degradation was compared between the apparatus of the first embodiment of the invention and a Protos 8000 cigarette making machine by measuring the weight percentage of "long strands" remaining in samples of a blend composition processed by each apparatus. The blend composition was cased and top dressed and had an overall moisture content of 12.5 percent by weight and comprised of: approximately 11 percent by weight of volume expanded cut filler tobacco, of which 11 percent by weight approximately 65 percent by weight was volume expanded flue cured tobacco and approximately 35 percent by weight was volume expanded Burley tobacco; approximately 4 percent by weight tobacco "shorts"; approximately 17 percent by weight Burley tobacco cut filler; approximately 22 percent by weight flue cured tobacco cut filler, approximately 19 percent by weight oriental tobacco cut filler; and approximately 26 percent by weight reconstituted tobacco sheet cut filler. The cut filler was pieces or shreds of tobacco cut at about 32 cuts per inch. This blend composition was comprised of 49 percent by weight of "long strands", which formed the standard to determine the extent of degradation due to processing.

For the present invention, a sample of the above blend composition was taken at the exit end of the suction chamber arrangement prior to being transferred to the garniture of the cigarette making machine. For the Protos 8000, a sample of the above blend composition was taken at the exit end of the suction chamber prior to being transferred to the cigarette making machine garniture. The results of the degradation comparison were that the long strands were reduced from 49 to 41 percent by weight for the Protos 8000, whereas for the apparatus of the present invention, the weight percentage of long strands remained essentially constant at approximately 49 percent by weight. Thus, the prior art apparatus resulted in a tobacco degradation of approximately 16 percent, whereas there was essentially no observed degradation using the apparatus of the present invention.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that this invention be limited only to the extent required by the appended claims and the applicable rules of law.

What is claimed is:

1. Apparatus for delivering smokable material to a cigarette maker comprising:

(a) means for holding a supply of the smokable material;

(b) means for metering the smokable material from the holding means to provide a metered smokable material;

(c) means for opening the metered smokable material and forming a falling shower of that smokable material;

(d) means for entraining the opened and falling smokable material in an airstream, the airstream having a velocity component in the direction of gravity; and (e) means disposed beneath the entraining means for forming the entrained smokable material into a braid for transfer to a cigarette maker such that said smokable material is transferred directly from said opening means to said braid forming means.

2. Apparatus as in claim 1, wherein the means for metering the smokable material comprises first and second rollers mounted substantially parallel to each other, each roller having a plurality of pins attached thereto, said pins of each roller interdigitating with the pins of the other roller, and including means for counterrotating said rollers with respect to each other.

3. Apparatus as in claim 2, wherein the means for opening the smokable material comprises a third roller rotatably mounted substantially parallel to and below said first and second rollers, said third roller having a plurality of pins attached thereto, said pins of said third roller interdigitating with said pins of said first and second rollers, and including means for rotating said third roller in the direction of rotation of one of said first or second rollers at a rotational speed greater than the first and second rollers.

4. Apparatus as in claim 1, wherein said entrainment means comprises first and second walls having inner and outer surfaces, said walls being convergent toward said braid forming means, each wall having an air inlet through which an airstream is drawn in a direction toward said braid forming means so as to pass over the inner surfaces of said walls.

5. Apparatus as in claim 1, wherein said entrainment means comprises first and second walls having inner and outer surfaces, said walls being convergent toward said braid forming means, each wall having an air inlet through which an airstream is drawn in a direction toward said braid forming means so as to pass over the inner surfaces of said walls approximately 45 degrees from the horizontal, said opening means being disposed in the path of the smokable material as the smokable material descends from said metering means.

6. Apparatus as in claim 4, wherein each said airstream is interposed between said walls and said shower of smokable material from said opening means.

7. Apparatus as in claim 1, wherein said means for metering the smokable material and said means for opening the smokable material comprises first and second rollers mounted substantially parallel to each other, each said roller having a plurality of pins attached thereto, said pins of each roller interdigitatable with the pins of the other roller, means for counterrotating said rollers and means for reciprocating at least one of said rollers along the longitudinal axis thereof.

8. Apparatus as in claim 7, wherein said first and second rollers are rotated at approximately 2 to 3 revolutions per minute and said first and second rollers are reciprocated at approximately 1000 to 3000 cycles per minute, at an amplitude of approximately 0.030 inch to 0.100 inch.

9. Apparatus as in claim 1, further comprising a housing having walls, said entraining means disposed such that said airstream is directly beneath said shower of smokable material from said opening means so as to reduce contact of said shower with said walls.

10. Apparatus as in claim 1, further comprising means for transferring the smokable material braid including:

(e) first means for conveying the smokable material, said first conveying means having a first movable surface, and located at a first location;

(f) first means for applying a first pressure gradient across a first portion of first movable surface so as to retain the smokable material on said first movable surface;

(g) a second portion of said first movable surface across which there is no applied pressure gradient;

(h) second means for conveying the smokable material to a second location, said second conveying means being disposed with respect to said first conveying means such that said first and second movable surfaces are in opposing, at least partially overlapping relation; and (i) second means for applying a second pressure gradient across said second movable surface, said second pressure gradient means located at or near said second portion of said first movable surface so as to transfer the smokable material braid from said first movable surface to said second movable surface and retain the smokable material braid thereon.

11. Apparatus as in claim 1, further comprising means for transferring the smokable material braid including:

(f) a first suction chamber having disposed thereon a first suction belt trained about a system of pulleys and rollers, at least one of which pulleys and rollers is adapted to be driven, and divided into first and second subchambers, said first subchamber communicating with a vacuum fan;

(g) a second suction chamber having disposed thereon a second suction belt trained about a system of pulleys and rollers, at least one of which pulleys and rollers is adapted to be driven, and divided into third and fourth subchambers, said fourth subchamber communicating with a vacuum fan;

(h) said first suction chamber disposed to receive the smokable material at a first location;

(i) said second suction chamber disposed to transfer the smokable material at a second location;

(j) said first subchamber of said first suction chamber communicating with said third subchamber of said second suction chamber such that a pressure gradient exists in the direction from said third subchamber to said first subchamber;

(k) said second subchamber of said first suction chamber communicating with said fourth subchamber of said second suction chamber such that a pressure gradient exists in the direction from said second subchamber to said fourth subchamber; and (l) said first and second suction chambers aligned such that the smokable material is transferred from said first suction belt to said second suction belt.

12. Apparatus for delivering smokable material to a cigarette maker comprising:

(a) means for holding a supply of the smokable material;

(b) means for metering the smokable material from the holding means;

(c) means for opening the metered smokable material and forming a shower of smokable material;

(d) means for entraining the opened smokable material in an airstream, the airstream having a velocity component in the direction of gravity;

(e) means disposed beneath the entraining means for forming the smokable material into a braid for transfer to a cigarette maker;

(f) first means for conveying the braid, said first conveying means having a first movable surface located at least partly beneath said entraining means;

(g) first means for applying a first pressure gradient across a first portion of said first movable surface so as to retain the braid on said first movable surface;

(h) a second portion of said first movable surface across which there is no applied pressure gradient;

(i) second means for conveying the braid to a garniture of a cigarette maker, said second conveying means being disposed with respect to said first conveying means such that said first and second movable surfaces are in opposing, at least partially overlapping relation; and (j) second means for applying a second pressure gradient across said second movable surface, said second pressure gradient means located at or near said second portion of said first movable surface so as to transfer the braid from said first movable surface to said second movable surface and retain the braid thereon.

13. Apparatus as in claim 12, wherein said first and second portions of said first movable surface are separated by a partition between a first subchamber and a second subchamber, wherein said first subchamber is attached to suction means for maintaining said first subchamber at a lower pressure than said second subchamber.

14. Apparatus for blending and delivering smokable material to a cigarette maker, comprising:

(a) a plurality of hoppers, each of said hoppers including:

(i) means for holding a supply of smokable material;

(ii) means for metering the smokable material;

(iii) means for opening the metered smokable material;

(iv) means for increasing the velocity in the direction of gravity of the opened smokable material and discharging said material from the hopper associated therewith; said holding means, said metering means, said opening means, and said velocity increasing means disposed in vertical relation;

(b) means attached to said plurality of hoppers for receiving the smokable material discharged from the hoppers and for uniformly blending said smokable material together;

(c) means for receiving the blended smokable material and forming it into a braid for transfer to a cigarette maker.

15. Apparatus as in claim 14, wherein said metering means and said opening means are each rotatably disposed transverse to the discharge direction of said smokable material.

16. Apparatus for blending and delivering smokable material to a cigarette maker, comprising:

(a) a plurality of hoppers, each of said hoppers including:

(i) means for holding a supply of smokable material;

(ii) means for metering the smokable material;

(iii) means for opening the metered smokable material;

(iv) means for increasing the velocity in the direction of gravity of the opened smokable material and discharging said material from the hopper associated therewith;

(b) means attached to said plurality of hoppers for receiving the smokable material discharged from the hoppers and for uniformly blending said smokable material together;

(c) means for receiving the blended smokable material and forming it into a braid for transfer to a cigarette maker, said braid forming means comprising:

(i) first means for conveying the braid, said first conveying means having a first movable surface located at least partly beneath said blending means;

(ii) first means for applying a first pressure gradient across a first portion of said first movable surface so as to retain the braid on said first movable surface;

(iii) a second portion of said first movable surface across which there is no applied pressure gradient;

(iv) second means for conveying the braid to a garniture of a cigarette maker, said second conveying means being disposed with respect to said first conveying means such that said first and second movable surfaces are in opposing, at least partially overlapping relation; and (v) second means for applying a second pressure gradient across said second movable surface, said second pressure gradient means located at or near said second portion of said first movable surface so as to transfer the braid from said first movable surface to said second movable surface and retain the braid thereon.

17. Apparatus as in claim 16, wherein said smokable material is transferred directly from said opening means through said receiving means to said braid forming means.

18. Apparatus for delivering smokable material to a cigarette maker comprising:

(a) a reservoir tube for holding a supply of smokable material;

(b) a pair of rollers mounted beneath said reservoir tube, each roller having a plurality of pins attached thereto, the pins of a first roller of said pair of rollers interdigitating with the pins of a second roller of said pair of rollers;

(c) means for counterrotating said rollers;

(d) a third roller mounted below said pair of rollers and having a plurality of pins attached thereto, the pins of the third roller interdigitating with the pins of the first and second rollers;
(e) means for rotating said third roller;
(f) a housing for enclosing said rollers, said housing having a pair of inclined walls converging below said rollers, said housing having at least one air inlet;
(g) means for creating an air flow through said air inlet so as to increase the velocity in the direction of gravity of the smokable material traveling through said housing;
(h) throat means attached to the convergent ends of said inclined walls for receiving the smokable material having increased velocity from the housing; and
(i) braid forming means connected to said throat means for forming the smokable material into a braid for transfer to a cigarette maker.

19. Apparatus as in claim 18, wherein said airflow is located beneath said third roller so as to be interposed between said inclined walls and smokable material coming from said third roller.

20. Apparatus for delivering smokable material to a cigarette maker comprising:
(a) a reservoir tube for holding a supply of smokable material;
(b) a pair of rollers mounted beneath said reservoir tube, each roller having a plurality of pins attached thereto, the pins of a first roller of said pair of rollers interdigitating with the pins of a second roller of said pair of rollers;
(c) means for counterrotating said rollers;
(d) a third roller mounted below said pair of rollers and having a plurality of pins attached thereto, the pins of the third roller interdigitating with the pins of the first and second rollers;
(e) means for rotating said third roller;
(f) a housing for enclosing said rollers, said housing having a pair of inclined walls converging below said rollers, said housing having at least one air inlet;
(g) means for creating an air flow through said air inlet so as to increase the velocity of the smokable material traveling through said housing;
(h) throat means attached to the convergent ends of said inclined walls for receiving the smokable material from the housing; and
(i) braid forming means connected to said throat means for forming the smokable material into a braid for transfer to a cigarette maker, said braid forming means comprising:
(1) first means for conveying the braid, said first conveying means having a first movable surface located at least partly beneath said throat means;
(2) first means for applying a first pressure gradient across a first portion of said first movable surface so as to retain the braid on said first movable surface;
(3) a second portion of said first movable surface across which there is no applied pressure gradient;
(4) second means for conveying the braid to a garniture of a cigarette maker, said second conveying means being disposed with respect to said first conveying means such that said first and second movable surfaces are in opposing, at least partially overlapping relation; and
(5) second means for applying a second pressure gradient across said second movable surface, said second pressure gradient means located at or near said second portion of said first movable surface so as to transfer the braid from said first movable surface to said second movable surface and retain the braid thereon.

21. Method for delivering smokable material to a cigarette maker, comprising the steps of:
(a) holding a supply of smokable material;
(b) metering the smokable material;
(c) opening the smokable material to form a shower of smokable material;
(d) entraining the opened smokable material in an airstream, said airstream having a velocity component in the direction of gravity;
(e) forming the smokable material which is entrained into a braid, said entraining step located such that said smokable material is transferred directly from said opening step to said braid forming step; and
(f) transferring the smokable material braid to a cigarette maker.

22. Method as in claim 21, wherein said entraining step uses an apparatus having a housing having walls, said entraining apparatus disposed such that said airstream is directly beneath said shower of smokable material from said opening step so as to reduce contact of said shower with said walls.

23. Method as in claim 21 further comprising the steps of:
(g) conveying the smokable material on a first movable surface beginning at a first location;
(h) applying a first pressure gradient across a first portion of said first movable surface so as to retain the smokable material on said first movable surface;
(i) maintaining the pressure along a second portion of said first movable surface so that there is essentially no pressure gradient across said second portion;
(j) conveying the smokable material to a second location on a second movable surface, said second movable surface being disposed with respect to said first movable surface such that said first and second movable surfaces are in opposing, at least partially overlapping relation; and
(k) applying a second pressure gradient across said second movable surface, said second pressure gradient being applied at a location at or near a location of said second portion of said first movable surface so as to transfer the braid from said first movable surface to said second movable surface and retain the smokable material thereon.

24. Method for delivering smokable material to a cigarette maker comprising the steps of:
(a) holding a supply of smokable material;
(b) metering the smokable material;
(c) opening the smokable material;
(d) entraining the opened smokable material in an airstream, said airstream having a velocity component in the direction of gravity;
(e) forming the smokable material into a braid; and
(f) transferring the smokable material braid to a cigarette maker, said braid transferring step comprising the steps of:
(1) conveying the braid on a first movable surface a location beginning beneath said entraining step;

(2) applying a first pressure gradient across a first portion of said first movable surface so as to retain the braid on said first movable surface;

(3) maintaining the pressure along a second portion of said first movable surface so that there is essentially no pressure gradient across said second portion;

(4) conveying the braid to a garniture of a cigarette maker on a second movable surface, said second movable surface being disposed with respect to said first movable surface such that said first and second movable surfaces are in opposing, at least partially overlapping relation; and (5) applying a second pressure gradient across said second movable surface, said second pressure gradient being applied at a location at or near a location of said second portion of said first movable surface so as to transfer the braid from said first movable surface to said second movable surface and retain the braid thereon.

25. Method as in claim 24, wherein said entraining step is located such that said smokable material is transferred directly from said opening step to said braid forming step.

26. Method for blending and delivering smokable material to a cigarette maker, comprising the steps of:

(a) providing a plurality of hopper devices each performing the steps of:

(i) holding a supply of smokable material;

(ii) metering the smokable material;

(iii) opening the metered smokable material;

(iv) increasing the velocity in the direction of gravity the opened downward moving smokable material and discharging the smokable material from the hopper associated therewith, said holding step, said metering step, said opening step and said velocity increasing step disposed in vertical relation;

(b) receiving the smokable material discharged from the hopper devices;

(c) blending the smokable material together;

(d) receiving the blended smokable material and forming it into a braid; and (e) transferring the braid of smokable material to a cigarette maker.

27. Method as in claim 26, wherein said metering step and said opening step are each performed by apparatus rotatably disposed transverse to the discharge direction of said smokable material.

28. Method for blending and delivering smokable material to a cigarette maker, comprising the steps of:

(a) providing a plurality of hopper devices each performing the steps of:

(i) holding a supply of smokable material;

(ii) metering the smokable material;

(iii) opening the metered smokable material;

(iv) increasing the velocity of the opened smokable material and discharging the smokable material from the hopper associated therewith;

(b) receiving the smokable material discharged from the hopper devices;

(c) blending the smokable material together;

(d) receiving the blended smokable material and forming it into a braid; and (e) transferring the braid of smokable material to a cigarette maker, said braid transferring step comprising the steps of:

(i) conveying the braid on a first movable surface at a location beginning beneath said braid forming step;

(ii) applying a first pressure gradient across a first portion of said first movable surface so as to retain the braid on said first movable surface;

(iii) maintaining the pressure along a second portion of said first movable surface so that there is essentially no pressure gradient across said second portion;

(iv) conveying the braid to a garniture of a cigarette maker on a second movable surface, said second movable surface being disposed with respect to said first movable surface such that said first and second movable surfaces are in opposing, at least partially overlapping relation; and (v) applying a second pressure gradient across said second movable surface, said second pressure gradient being applied at a location at or near a location of said second portion of said first movable surface so as to transfer the braid from said first movable surface to said second movable surface and retain the braid thereon.

29. Method as in claim 28, wherein said smokable material is transferred directly from said opening step through said receiving and blending steps to said braid forming step.

30. Apparatus for delivering smokable material to a cigarette maker comprising:

(a) means for holding a supply of the smokable material;

(b) means for metering the smokable material from the holding means, said means for metering the smokable material comprising first and second rollers mounted substantially parallel to each other, each roller having a plurality of pins attached thereto, said pins of each roller interdigitating with the pins of the other roller, and including means for counterrotating said rollers with respect to each other, said first and second rollers rotated at approximately 2 to 3 revolutions per minute;

(c) means for opening the metered smokable material and forming a shower of smokable material, said means for opening the smokable material comprising a third roller rotatably mounted substantially parallel to and below said first and second rollers, said third roller having a plurality of pins attached thereto, said pins of said third roller interdigitating with said pins of said first and second rollers, and including means for rotating said third roller in the direction of one of said first or second rollers at a rotational speed greater than the first and second rollers, said third roller rotated at approximately 200 revolutions per minute;

(d) means for entraining the opened smokable material in an airstream, the airstream having a velocity component in the direction of gravity; and (e) means disposed beneath the entraining means for forming the smokable material into a braid for transfer to a cigarette maker.

31. Apparatus as in claim 30 wherein said smokable material is transferred directly from said opening means to said braid forming means.

32. Apparatus for delivering smokable material to a cigarette maker comprising:

(a) means for holding a supply of the smokable material;

(b) means for metering the smokable material from the holding means to provide a metered smokable material;

(c) means for opening the metered smokable material and forming a falling shower of that smokable material;

(d) means for entraining the opened and falling smokable material in an airstream, the airstream having a velocity component in the direction of gravity; and (e) means disposed beneath the entraining means for forming the entrained smokable material into a braid for transfer to a cigarette maker;

said holding means, said metering means, said opening means, said entraining means and said braid forming means arranged such that said smokable material is sequentially acted upon by each of such means.

* * * * *

UNITED STATES PATENT AND TRADEMARK OFFICE

CERTIFICATE OF CORRECTION

PATENT NO. : 5,159,939

DATED : November 3, 1992

INVENTOR(S) : Clifford R. Marritt, et. al.

It is certified that error appears in the above-indentified patent and that said Letters Patent is hereby corrected as shown below:

On the Title page, item [56], under U.S. Patent Documents:

"4,214,695" should be --4,214,595--.

Col. 13, lines 54-63 should be deleted. Claim 5 should be --Apparatus as in claim 4, wherein said first wall is inclined at an angle of approximately 65 degrees from the horizontal and said second wall is inclined at an angle of approximately 45 degrees from the horizontal, said opening means being disposed in the path of the smokable material as the smokable material descends from said metering means.--

Col. 16, line 19, delete "in the direction of gravity".

Signed and Sealed this

Nineteenth Day of October, 1993

Bruce Lehman

*Attest:*

BRUCE LEHMAN

*Attesting Officer*

*Commissioner of Patents and Trademarks*